US006012400A

United States Patent [19]

Sosso

[11] Patent Number: 6,012,400

[45] **Date of Patent: *Jan. 11, 2000**

[54] SHELVING SUPPORT PIN

[75] Inventor: Peter F. Sosso, Minneapolis, Minn.

[73] Assignee: Stein Industries, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,656

[22] Filed: Mar. 26, 1998

[51] Int. Cl.[7] ..... A47B 9/00

[52] U.S. Cl. ..... 108/108; 312/408

[58] Field of Search ..... 108/108, 110, 108/152; 211/182, 183, 186; 312/408; 248/250; 24/616, 171

[56] References Cited

U.S. PATENT DOCUMENTS

| | | |
|---|---|---|
| Re. 32,435 | 6/1987 | Carlstrom . |
| 1,767,745 | 6/1930 | Day . |
| 4,334,659 | 6/1982 | Yuda . |
| 4,393,561 | 7/1983 | Yuda . |
| 4,416,040 | 11/1983 | Towsley . |
| 4,534,472 | 8/1985 | Hanseler et al. . |
| 4,633,549 | 1/1987 | Lovato . |
| 4,844,645 | 7/1989 | Rasmussen . |
| 5,138,116 | 8/1992 | Kabayama . |
| 5,226,717 | 7/1993 | Hoffman . |
| 5,542,871 | 8/1996 | Gabriel . |

*Primary Examiner*—Anthony Knight
*Assistant Examiner*—Karlena D. Schwing
*Attorney, Agent, or Firm*—Nawrocki, Rooney & Sivertson, P.A.

[57] ABSTRACT

A removable support pin which provides enhanced mounting flexibility in the attachment of new and replacement shelving/rack display units within a wide variety of refrigerated display cases. The support pin has two ends: a first end designed to engage a shelving display unit to be placed within the refrigerated case and a second end designed to engage a U-shaped mounting rail positioned within the refrigerated case.

15 Claims, 4 Drawing Sheets

SHELVING SUPPORT PIN

BACKGROUND OF THE INVENTION

1. Field of the Invention

This invention relates to a support structure for a shelf system. More specifically, this invention provides a removable mounting pin used to support shelving in the display portion of supermarket refrigerated cases.

2. Description of the Prior Art

Refrigerated display cases are a common feature of modern grocery stores. Typical refrigerated cases have a bottom and four lower sides defining a well, the well serving as a settling area for cool, refrigerated air, and as a display area for food products. Many modern refrigerated cases also have a tall back and top overhang with an open front to allow customers to view, inspect, and retrieve food items.

Competitive pressures have forced grocers to improve the display of goods in their refrigerated cases. However, the costs of replacing functioning units with new units to improve the merchandising shelf space is prohibitive. As an alternative, grocers have installed upgraded shelves which improve the display of goods in their existing refrigerated display cases. These refrigerated case conversions often increase the utilization of vertical space within the refrigerated cases, and the visual impact of products.

Known replacement shelving units employ slotted rails or channels carried by the shelves and holes already present within the case. It is current industry practice to attach stamped aluminum fastening parts to the shelf mounting rails by twisting them within holes/slots found within the rails. A projecting tip of the fasteners cooperate with holes in the case to support the shelves. Alternatively, the well-known combination of bolt/washer/nut has also been employed to secure the shelves in the case. The shelves also have parts welded to the rails for securement of the shelves within the case.

Each of these attachment techniques presents a unique set of disadvantages. The twisting of aluminum fastening parts within the rail slots will permanently damage the rail holes/slots, thus preventing their subsequent use in future shelving applications. In addition to reusability, the aluminum fasteners are relatively expensive to produce. While the bolt/washer/nut fastening mechanism will not permanently damage the rail holes/slots, this attachment technique is very slow and labor intensive, thus expensive. Finally, the welding technique also presents problems of reusability, adjustability and cost.

SUMMARY OF THE INVENTION

The present invention provides a removable support pin which provides enhanced mounting flexibility in the attachment of new and replacement shelving units within a wide variety of refrigerated display cases. The support pin has two ends: a first end designed to engage a hole within the refrigerated case and a region at a second end designed to engage a U-shaped mounting rail or channel carried by the shelves. The rails also provide a structural stability to the shelf unit, in known manner.

In a preferred embodiment, the first end of the support pin has a spherical knob designed to engage a mated opening of a refrigerated case. The projecting spherical knob is positioned at a predetermined angle relative to the body of the pin. In the present invention, this predetermined angle is approximately 30 degrees. It is contemplated that this angle may vary to accommodate variations in embodiments of refrigerated cases and/or shelving display units. Typically, refrigerated cases have matched sets of holes to accommodate varying shelf configurations.

In accordance with the present invention, the region at the second end of the support pin has a flattened portion designed to be inserted through slotted, aligned holes positioned within the front and back legs of the mounting rail. One surface of the flattened portion of the pin also has a locking tab, including an end which projects at an acute angle from the surface of the flattened portion of the pin in the general direction of the knob end of the pin.

As the second (locking tab) end of the support pin is inserted through the slotted holes of the mounting rail, the top edge of the slotted hole will deflect the projecting end of the locking tab toward the flattened surface of the pin such that the end of the pin having the locking tab may pass through the slotted hole.

As the second (locking tab) end of the pin emerges from the back side of the slotted hole in the back leg of the mounting rail, the projecting end of the locking tab will be released by the top edge of the slotted hole and will spring back such that the projecting end of the locking tab will now engage the mounting rail above the top surface of the slotted hole, thus preventing removal of the locking tab from the back slot of the mounting rail.

At this same time, a shoulder molded into the surface of the pin will abut against a leg of the mounting rail, thus limiting the amount of insertion of the pin into the mounting rail. Thus, the pin will be effectively longitudinally "locked" into place through the cooperation of the shoulder which prevents further insertion of the pin and the locking tab which prevents removal of the pin. Further, rotation of the pin may also be prevented while in the locked position, by cooperation of the back slotted hole of the mounting rail and the flat portion of the pin when the pin is longitudinally "locked" in place. It is important to prevent the rotation of the pin so that the shelf attachment knob at the other end of the pin is maintained in a proper angled relationship to the shelving unit for proper attachment.

The pin may removed from the mounting rail by applying force on the projecting end of the locking tab such that the end is deflected toward the body of the pin, thus flattening the profile of the end of the pin such that it can be successfully withdrawn through the slotted hole in the back leg of the mounting rail.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
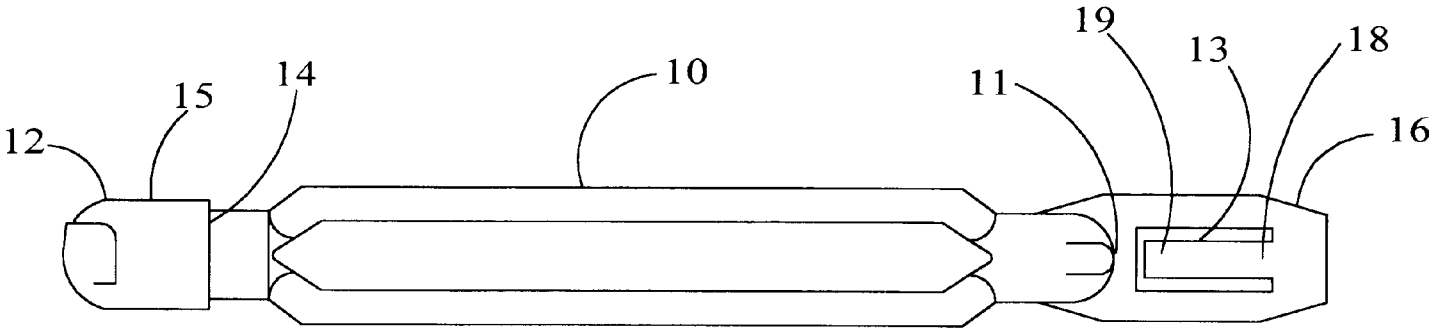
FIG. 1 is a top view of a removable support pin in accordance with the present invention.

FIG. 1 illustrates a removable support pin 10 in top view perspective. In a preferred embodiment, the support pin 10 is an elongated, one piece device made of plastic, for example, DuPont Zytel 72633 (33% glass filled nylon), having a total length of approximately 3.5 inches, and a center body width of approximately 0.266 inches. A first end 15 of the support pin 10 has a knob 12 for supporting a shelving unit. The knob 12 may have a variety of shapes and sizes in order to accommodate the mating structure of the corresponding case. In a preferred embodiment, the knob 12 terminus has a generally spherical shape. A lip 14 in the knob 12 will engage the back of the wall of the case in which the shelf is mounted in a manner described more fully below.

The second end 16 of the support pin 10 is designed to be inserted into a mounting rail in a shelving unit. The generally flat surface of the second end is designed to fit within slotted holes found in the mounting rail (described below). This second end 16 has a locking tab 13 which is designed to "lock" the support pin into place after it has been completely inserted into the mounting rail. The second end 16 also has a shoulder 11 which limits the amount of insertion of the pin through the mounting rail.

Figure 2:
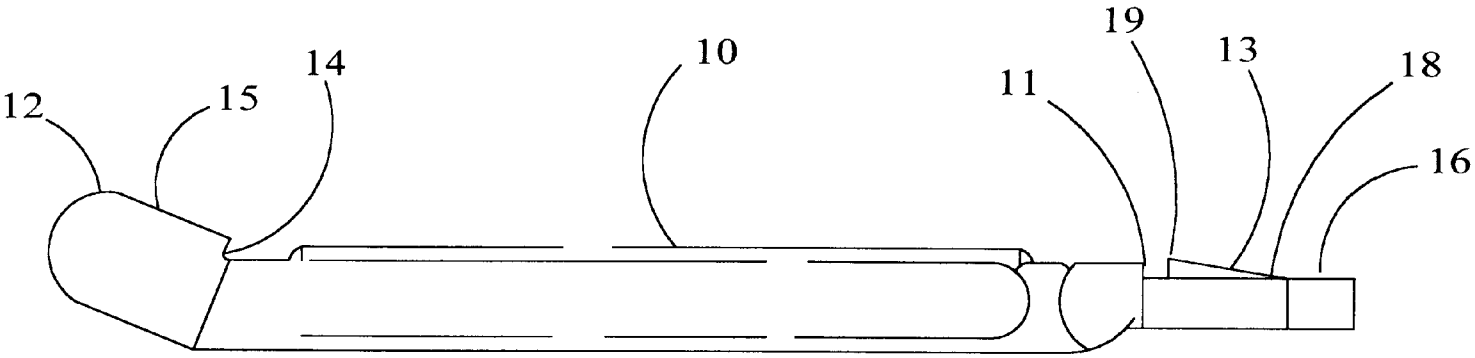
FIG. 2 is a side view of the removable support pin of FIG. 1.

FIG. 2 further illustrates the removable support pin 10 through a perspective side view. The knob 12 at the first end 15 of the support pin 10 projects at an angle relative to the body of the pin 10. In a preferred embodiment, this angle is approximately 30 degrees. However, this angle may vary for differing embodiments of refrigerated display cases and/or shelving systems. FIG. 2 also further illustrates the locking tab 13 of the removable shelf support pin 10. The locking tab 13 may be integrally molded with the pin 10 to project from the body of the pin at 18 at an upward angle toward projecting end 19, such that the projecting end of the tab 19 lies above the flat surrounding surface of the second end of the support pin 16.

Figure 3:
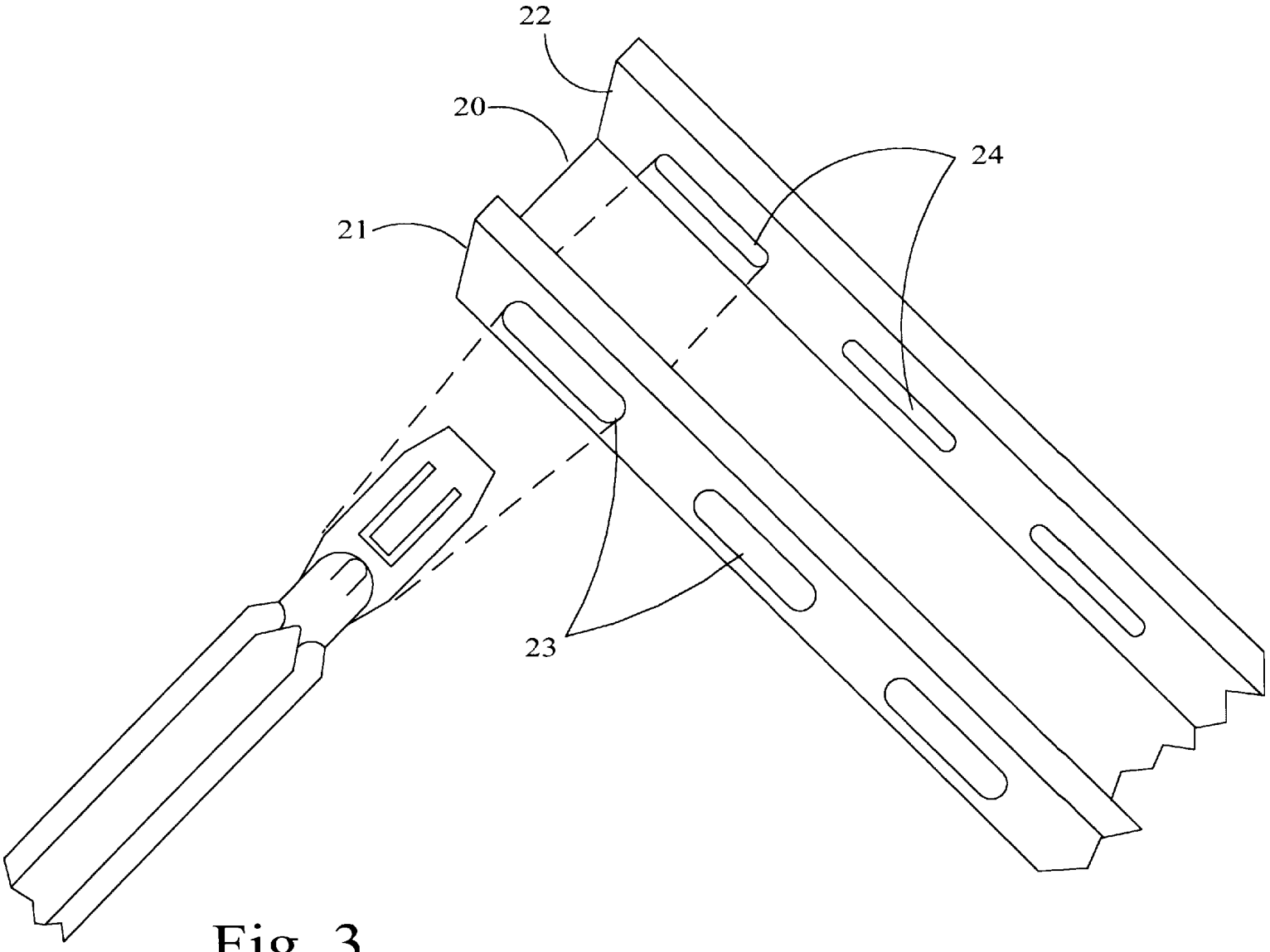
FIG. 3 is an exploded view of the locking end of the removable support pin of FIG. 1 in alignment with cooperating mounting rail slots.

FIG. 3 is an exploded, close-up view of the locking pin end of the removable support pin 10 being inserted into a mounting rail 20. A mounting rail such as mounting rail 20 is positioned along the front and rear edges of the shelving unit. A series of vertical holes in the refrigerated case provide the connection point at which a shelf assembly is attached to the case. In a preferred embodiment, the mounting rail 20 is made of a metal, such as steel. The mounting rail 20 is U-shaped, having two parallel legs 21 and 22 running lengthwise at the front and back edges of the rail, front and back being relative to the edge of the shelf unit at which the rail is located with front being closest to the edge. Positioned along the mounting rail legs 21 and 22 are a set of elongated front slots 23 and a set of elongated back slots 24, respectively, positionally aligned such that the second end 16 of the removable support pin 10 may be passed through the front slot 23 and the back slot 24 of the mounting rail legs 21 and 22. The height of the opening of front set of slots 23 is generally greater than the height of the opening of the back set of slots 24, thus providing ease of insertion through the front set of slots 23, and a tighter fit through the second set of slots 24. The spacing between the slots corresponds to the spacing between vertical sets of holes in the walls of cases of different manufacturers.

Figure 4:
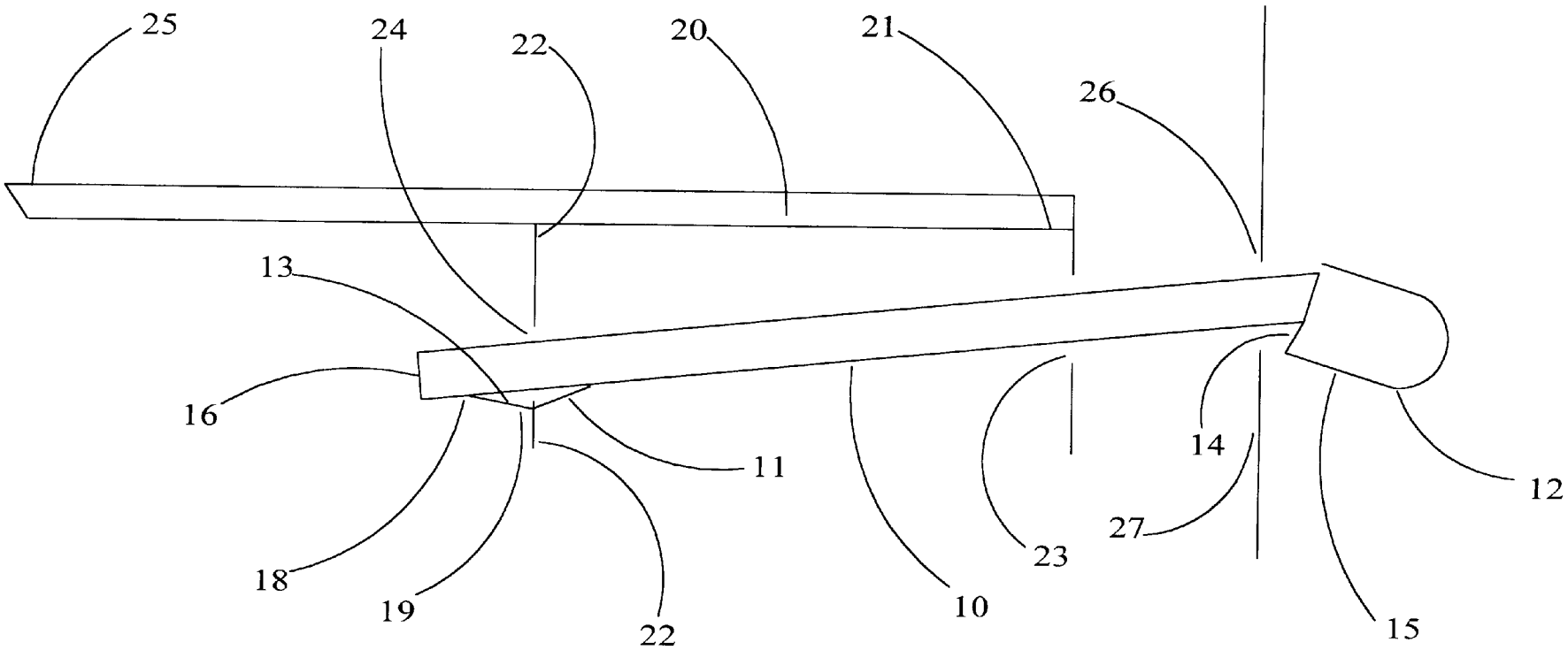
FIG. 4 is a cross-sectional view of a shelving unit in accordance with the present invention, including the removable support pin of FIG. 1, within a mounting rail of the shelving unit and a cooperating hole within the wall of a refrigerated case.

FIG. 4 is a cross-sectional view of the removable support pin 10, the mounting rail 20, and a shelving unit shown partially at 25. The shelving unit 25 may be either a standard display shelf or a rack. The wall of a refrigerated case is also represented at 27 with a hole 25 representing the series of holes by which the knobs 12 of a plurality of support pins 10 will support the shelving unit. Typically, there will be a support pin 10 at each corner of a shelving unit 25. The majority of the length of the support pin 10 will be encompassed within the mounting rail 20 when the support pin 10 is locked into place. The lip 14 will engage the rear wall of 27 to hold the knob 15 of pin 10 within the hole 26 of wall 27.

Figure 5:
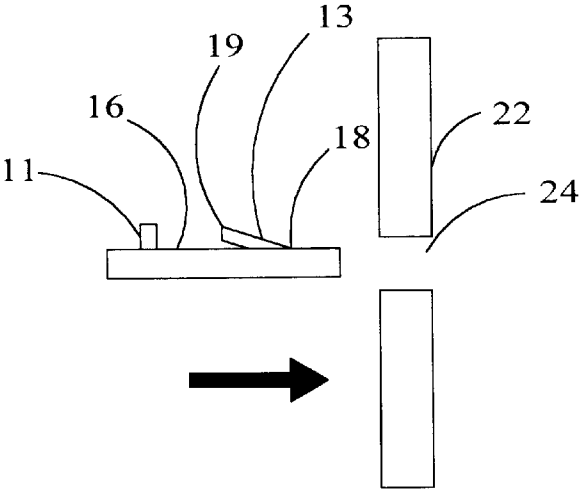
FIG. 5 is simplified, cross-sectional view of the locking end of a removable support pin in accordance with the present invention and a slotted hole in the back leg of a mounting rail prior to insertion.

FIG. 5 is a simplified, cross-sectional view of the locking pin (second) end 16 of the removable support pin 10 and a slotted hole 24 in the back leg 22 of the mounting rail prior to insertion. Prior to insertion, the projecting end 19 of the locking tab 13 angles upwardly from the body of the pin at 18. The spacing between the projecting end of the tab 19 and the shoulder 11 is slightly larger than the width of the metal in the back leg 22 of the mounting rail 22.

Figure 6:
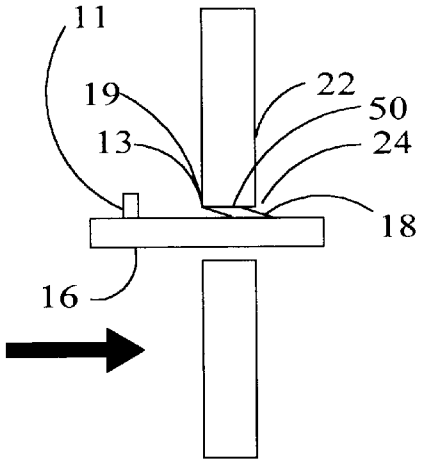
FIG. 6 is a simplified, cross-sectional view of the locking pin end of the removable support pin and a slotted in the back leg of the mounting rail as the locking tab passes through the slotted hole.

FIG. 6 is a simplified, cross-sectional view of the locking pin (second) end 16 of the removable support pin 10 and a slotted hole 24 in the back leg 22 of the mounting rail as the locking tab 13 passes through the slotted hole 24. As the locking tab 13 passes through the slotted hole 24, the projecting end of the locking tab is deflected in a camming action by the top edge of the slotted hole (camming surface) 50 such that the locking tab 13 is urged toward, and lies substantially flush with, the flat surface of the second end 16. This camming action will allow the locking tab 13 to pass through the opening of the slotted hole 24. Thus, the camming surface 50 located at the top of slot 24 provides a means for downwardly deflecting the projecting end 19 of the locking tab 13 as the tab is passed horizontally through the slot 24. This means is hereinafter identified as a camming surface means.

Figure 7:
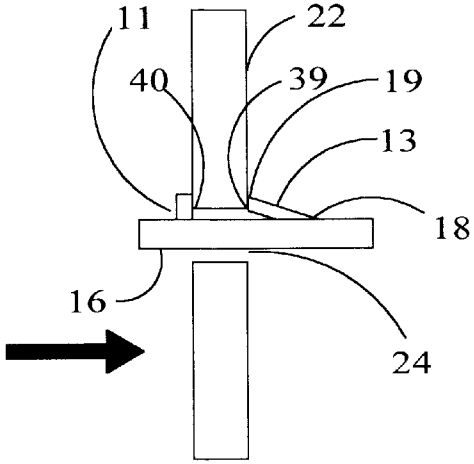
FIG. 7 is a simplified, cross-sectional view of the locking end of a removable support pin in accordance with the present invention and a slotted hole in the back leg of a mounting rail as the locking tab emerges from the back side of the slotted hole.

FIG. 7 is a simplified, cross-sectional view of the locking pin (second) end 16 of the removable support pin 10 and a slotted hole 24 in the back leg 22 of the mounting rail as the locking tab 13 emerges from the back side of the slotted hole 24 and springs back into its angled orientation to engage a rear surface 39 of the back leg 22 of the mounting rail 20. With the tab 13 engaging the surface 39, the support pin 10 may not be removed from the back slot 24 of the mounting rail 20 through a normal pulling action. At this same time, the integrally molded shoulder 11 of the support pin is now positioned substantially flush to the front surface 40 of the back leg 22 of the mounting rail 20 such that the support pin may not be further inserted into the back slot 24. Thus, the support pin 10 will be effectively longitudinally "locked" into place through the cooperatively competing forces of the shoulder 11 which prevents further insertion of the pin 10 and the locking tab 13 which prevents removal of the pin 10.

In addition to contributing to the longitudinal stability of the support pin, the elongation of back slotted hole 24 of the mounting rail 20 also provides rotational stability for the support pin. In particular, the perimeter of the back slotted hole 24 of the mounting rail 20 closely surrounds the flat portion of the second end of the pin 16 when the pin is longitudinally "locked" into place. This feature prevents the rotation of the flat portion of the support pin 10 within slot 24 such that the shelf attachment knob 12 at the other end of the pin is maintained in a proper angled relationship to the mounting rail 20 for engagement with the case wall (see FIG. 4).

The support pin 10 may be removed from the mounting rail 20 through the application of force on the projecting end 19 of the locking tab 13 such that the projecting end 19 is deflected toward the body of the pin 10, thus flattening the profile of the second end of the pin 16 so that the second end 16 can be successfully withdrawn through the slotted hole 24 in the back leg 22 of the mounting rail 20.

Numerous characteristics and advantages of the present invention have been set forth in the foregoing description. It will be understood, however, that this disclosure is, in many respects, only illustrative. For example, only that portion of the shelf unit which is necessary for understanding of the present invention has been described. In all respects, those portions of the shelf unit which are not described are of conventional design. Such designs typically have a telescoping capability which allows pins in accordance with the present invention to be employed along the front and rear of a shelf unit to engage holes in the front and rear walls of the well of the refrigerated case. Typically, such holes are provided to accommodate shelves of different heights. Changes may be made in details, particularly in matters of shape, size, and arrangement of parts without exceeding the scope of the invention. The invention's scope is, of course, defined in the language in which the appended claims are expressed.

What is claimed is:

1. A mounting system for use in a refrigerated case having holes within walls thereof, said mounting system comprising:

a shelf having a U-shaped mounting rail including first and second legs with aligned front and back slots in said legs; and a plurality of pins, each pin having an elongated body with a first region adjacent a first end, and a second region adjacent a second end, said first region having a projecting knob for engagement with one of the case wall holes and said second region being inserted through a front slot and into an aligned back slot of said mounting rail, said second region of said body having integral means for inhibiting longitudinal movement of said pin relative to said rail.

2. Apparatus as recited in claim 1, wherein said means for inhibiting longitudinal movement comprises a shoulder which limits the amount of insertion of said pin through said back slot of said mounting rail.

3. Apparatus as recited in claim 2, wherein said means for inhibiting longitudinal movement further comprises a locking tab projecting from said second region of said body.

4. Apparatus as recited in claim 3, wherein said locking tab is biased at an acute angle.

5. Apparatus as recited in claim 4, wherein said tab further comprises camming surface means for deflecting said tab by engagement with a slot of said mounting rail.

6. Apparatus as recited in claim 5, wherein said tab engages a surface of said mounting rail upon complete insertion of said pin through a back slot of said rail.

7. Apparatus as recited in claim 1, wherein said projecting knob of said first end of said body is positioned at a predetermined angle relative to said pin body.

8. Apparatus as recited in claim 7, wherein said predetermined angle is approximately 30 degrees.

9. Apparatus as recited in claim 8, wherein said projecting knob has a spherical terminus.

10. Apparatus as recited in claim 1, wherein the cross-section of said second region and said back slot prevent rotation of said pin within said back slot.

11. Apparatus as recited in claim 1, wherein said means for inhibiting longitudinal movement comprises a locking tab projecting from said second region of said body.

12. Apparatus as recited in claim 11, wherein said tab further comprises camming surface means for deflecting said tab by engagement with a slot of said mounting rail.

13. Apparatus as recited in claim 12, wherein said tab engages a surface of said mounting rail upon complete insertion of said pin through a back slot of said rail.

14. Apparatus as recited in claim 13, wherein the cross-section of said second region and said back slot prevent rotation of said pin within said back slot.

15. Apparatus as recited in claim 1 wherein said first region further compromises a lip for engagement with said case wall.

* * * * *